US006193844B1

(12) United States Patent
McLaughlin et al.

(10) Patent No.: US 6,193,844 B1
(45) Date of Patent: Feb. 27, 2001

(54) METHOD FOR MAKING PAPER USING MICROPARTICLES

(76) Inventors: John R. McLaughlin, 240 Highview La., Media, PA (US) 19063; Paul G. Linsen, 407 P Buttonwood Dr., West Chester, PA (US) 19317

( * ) Notice: Subject to any disclaimer, the term of this patent is extended or adjusted under 35 U.S.C. 154(b) by 0 days.

(21) Appl. No.: 09/395,493

(22) Filed: Sep. 14, 1999

Related U.S. Application Data

(63) Continuation-in-part of application No. 08/888,490, filed on Jul. 7, 1997, now Pat. No. 5,968,316, which is a continuation-in-part of application No. 08/716,561, filed on Sep. 16, 1996, now Pat. No. 5,704,556, which is a continuation-in-part of application No. 08/482,077, filed on Jun. 7, 1995, now abandoned.

(51) Int. Cl.[7] ..... D21H 17/68; D21H 21/10

(52) U.S. Cl. ..... 162/181.6; 162/175; 162/164.6; 162/181.7; 162/168.2

(58) Field of Search ..... 162/181.1, 181.3, 162/181.6, 183, 175, 164.1, 164, 6, 168.1–168.4

(56) References Cited

U.S. PATENT DOCUMENTS

| | | | |
|---|---|---|---|
| 1,793,670 | 2/1931 | Borrowman . | |
| 2,004,257 | 6/1935 | Tschirner . | |
| 2,621,859 | 12/1952 | Phillips . | |
| 2,678,168 | 5/1954 | Phillips . | |
| 3,090,567 | 5/1963 | Schafter et al. . | |
| 3,405,874 | 10/1968 | Brizon . | |
| 3,642,501 | 2/1972 | Minieri . | |
| 3,677,476 | 7/1972 | Harned . | |
| 3,804,656 | 4/1974 | Kaliski et al. . | |
| 3,816,080 | 6/1974 | Bomford et al. . | |
| 3,917,538 | 11/1975 | Rosensweig . | |
| 3,995,817 | 12/1976 | Brociner . | |
| 4,032,466 | 6/1977 | Otrhalek et al. . | |
| 4,065,544 | 12/1977 | Hamling et al. . | |
| 4,180,508 | 12/1979 | Becker et al. . | |
| 4,201,669 | 5/1980 | Becker et al. . | |
| 4,282,059 * | 8/1981 | Davidson | 162/158 |
| 4,332,354 | 6/1982 | deMonterey et al. . | |
| 4,343,706 | 8/1982 | Etzel et al. . | |
| 4,385,961 | 5/1983 | Svending et al. . | |
| 4,405,483 | 9/1983 | Kuzel et al. . | |
| 4,578,150 | 3/1986 | Hou . | |
| 4,581,153 | 4/1986 | Trabitzsch et al. . | |
| 4,624,418 | 11/1986 | Szkaradek . | |
| 4,627,959 | 12/1986 | Gilman et al. . | |
| 4,643,801 | 2/1987 | Johnson . | |
| 4,647,304 | 3/1987 | Petkovic-Luton et al. . | |
| 4,651,935 | 3/1987 | Samosky et al. . | |
| 4,676,439 | 6/1987 | Saito et al. . | |

(List continued on next page.)

FOREIGN PATENT DOCUMENTS

| | | |
|---|---|---|
| 92301137 | 8/1992 | (EP) . |
| 0620190 | 10/1994 | (EP) . |
| 55-104658 | 8/1980 | (JP) . |
| 15077443 | 8/1989 | (RU) . |

OTHER PUBLICATIONS

Painting and Coatings Industry, Jul. 1994, "Premilling Can Optimize Your Dispersion Process".
W.M. Meir et al., Molecular Sieves (1973), pp. 132–133.

* cited by examiner

*Primary Examiner*—Peter Chin
*Assistant Examiner*—Jose A. Fortuna
(74) *Attorney, Agent, or Firm*—Paul & Paul

(57) ABSTRACT

A microparticle composition for paper making includes finely divided particles of a water insoluble solid such as amorphous sodium aluminosilicate, and having an anionic charge of at least 20 millivolts, and preferably from about 40 to 60 millivolts, and a particle size of less than about 0.1 microns.

5 Claims, 3 Drawing Sheets

U.S. PATENT DOCUMENTS

| | | | |
|---|---|---|---|
| 4,787,561 | | 11/1988 | Kemp, Jr. et al. . |
| 4,795,531 | | 1/1989 | Sofia et al. . |
| 4,812,299 | | 3/1989 | Wason . |
| 4,844,355 | | 7/1989 | Kemp, Jr. et al. . |
| 4,892,590 | | 1/1990 | Gill et al. . |
| 4,902,382 | | 2/1990 | Sakabe et al. . |
| 4,913,361 | | 4/1990 | Reynolds . |
| 4,927,498 | | 5/1990 | Rushmere . |
| 4,954,220 | | 9/1990 | Rushmere . |
| 4,964,954 | | 10/1990 | Johansson . |
| 4,964,955 | * | 10/1990 | Lamar et al. ..... 162/164.6 |
| 4,966,331 | | 10/1990 | Maier et al. . |
| 4,969,976 | | 11/1990 | Reed . |
| 5,015,334 | | 5/1991 | Derrick . |
| 5,033,682 | | 7/1991 | Braun . |
| 5,065,946 | | 11/1991 | Nishida et al. . |
| 5,083,712 | | 1/1992 | Askew et al. . |
| 5,112,388 | | 5/1992 | Schulz et al. . |
| 5,147,449 | | 9/1992 | Grewe et al. . |
| 5,171,808 | | 12/1992 | Ryles et al. . |
| 5,176,891 | | 1/1993 | Rushmere . |
| 5,240,561 | | 8/1993 | Kaliski . |
| 5,270,076 | | 12/1993 | Evers . |
| 5,320,284 | | 6/1994 | Nishida . |
| 5,320,773 | | 6/1994 | Perman et al. . |
| 5,338,712 | | 8/1994 | MacMilan et al. . |
| 5,350,437 | | 9/1994 | Watanabe et al. . |
| 5,374,335 | | 12/1994 | Lindgren et al. . |
| 5,473,033 | | 12/1995 | Kuo e tal. . |
| 5,501,774 | | 3/1996 | Burke . |
| 5,514,249 | | 5/1996 | Cauley et al. . |

METHOD FOR MAKING PAPER USING MICROPARTICLES

CROSS-REFERENCE TO RELATED APPLICATIONS

This application is a continuation-in-part of U.S. patent application Ser. No. 08/888,490 filed Jul. 7, 1997, now U.S. Pat. No. 5,968,316, issued Oct. 19, 1999, which was a continuation-in-part of U.S. patent application Ser. No. 08/716,561, filed Sep. 16, 1996, now U.S. Pat. No. 5,704, 556, issued Jan. 8, 1998, which was a continuation-in-part of U.S. patent application Ser. No. 08/482,077 filed Jun. 7, 1995 now abandoned.

BACKGROUND OF THE INVENTION

1. Field of the Invention

The present invention relates to finely divided particles of water insoluble compounds that exhibit high negative zeta potentials at pH 7–8, small particle size, plus high adsorption of cationic material and compositions including such particles for use as drainage/retention aids in papermaking.

More particularly the present invention concerns submicron particles of metallic silicates such as crystalline alumino silicates (zeolites) and amorphous alumino silicates.

2. Brief Description of the Prior Art

The use of a variety of microparticle-based retention aids and drainage aids in systems that employ combinations of colloidal particles along with polymers such as cationic starches and/or synthetic cationic polymers is well established.

The pioneering system was EKA-Nobel's CompoSil™, based on colloidal silica and cationic potato starch. This was soon followed by Nalco's "Positek" TM System based on colloidal silica, cationic potato starch and an anionic polymer. Other systems employ variants of these ingredients, including Du Pont's work on silica-based microgels and Allied Colloid's "Hydracol"™, system based on bentonite. These technologies provide materials which are combined in a novel way to enhance the paper-making process.

While the concept of retention aids is well understood from an electro-chemical point of view, finding effective, low cost microparticles that emulate the performance of silica or bentonite has proven difficult.

Conceptually, the role of microparticles in these systems is to provide a large number of very small point sources of anionic charge around which cationic polymers, fine paper fibers and fillers form into flocs which aid in their retention. These fast forming, shear sensitive flocs also represent areas of high solids consistency and, therefore, act as dewatering mechanisms when they are "captured" by larger fibers. Because of their small size, they enhance paper formation. The high retention of polymers that they provide translates into strength advantages in the finished paper.

The desirable properties of ideal microparticles are: high numbers of low cost, non-toxic, small particles with stable (>20 millivolt) surface charges with a minimum impact on other paper making properties such as color, printability, porosity etc.

Presently, EKA-Nobel, Nalco and DuPont produce their own colloidal silicas in the United States and have provided retention aids systems for the paper industry based upon these silicas. Allied Colloids has a similar system that uses bentonite clay particles as a macroparticle in a competitive system.

SUMMARY OF THE INVENTION

The alkaline paper making industry prepares its furnishes at pH 7–8. The zeta potentials of silica, alumina and bentonite clays are well known. At pH 7–8 colloidal silica and bentonite clays have zeta potentials of minus sixty (−60) millivolts and minus forty (−40) millivolts respectively.

Systems employing either colloidal silica or bentonite clay are the primary commercial microparticles being used in retention/drainage aid systems on paper machines.

Surprisingly, many other compounds exhibit similar zeta potentials in the same pH range. However, these materials have not been used, apparently due to their comparatively large particle size and low surface area available for cationic adsorption.

The present invention provides aqueous suspensions of colloidal particles for use as microparticulate floc formers in two to three component systems used as retention aids and drainage aids on papermaking machines.

One object of this invention is to provide processes for the production of such aqueous suspensions of colloidal particles. In one such process, these alternative materials are processed through an agitated media mill in order to significantly reduce the particle size and thereby increase the surface area available for the adsorption of the various cationic materials found in paper furnishes. In another such process, a known process for preparing an aqueous sol comprising agglomerated particles of amorphous sodium aluminosilicate is modified to significantly reduce the particle size of the sol particles, once again thereby increasing the surface area available for adsorption of cationic materials.

Another object of the present invention is to provide stable dispersions of these materials in water or organic liquids, and to provide a method for producing such dispersions.

Stable dispersions of such particles are convenient, in that they allow the particles to be transported, while simultaneously inhibiting the particles from coalescing into larger agglomerates.

These and other objects and advantages have been achieved by the present invention wherein colloidal-sized particles of insoluble compounds with high anionic charges and high surface area can be provided by means of a high energy mill, such as a media mill, even though commercial suppliers of such milling equipment do not suggest that such particles sizes can be achieved. Alternatively, sols comprising colloidal-sized particles of amorphous insoluble compounds with high anionic charges and high surface area can be employed. Sols suitable for use in the present invention can be prepared by the process disclosed in U.S. Pat. No. 2,974,108, incorporated herein by reference, and modified as herein below described.

The present invention provides a drainage/retention aid system for papermaking, the system comprising finely divided particles (that is, "microparticles") of a water insoluble solid having an anionic charge of at least 20 millivolts, and preferably from about 40 to 60 millivolts. The particle size of the microparticles is preferably no greater than 0.1 micron, with a particle size no greater than about 0.04 micron being more preferred. The water insoluble solid is preferably a solid chemical compound is selected from the group consisting of amorphous aluminosilicates, such as amorphous sodium alumino silicate, and mixtures of crystalline alumino silicates and amorphous alumino silicates, such as mixtures of amorphous sodium aluminosilicate and zeolite A. For example, the water-insoluble solid can be amorphous aluminosilicate having the formula $MAlO_2XAl_2O_3.YSiO_2$, where X ranges from 0 to 25, Y ranges form 1 to 200, and M is a monovalent cation selected from the group consisting of elements of group 1A of the periodic table, ammonium, and substituted ammonium ions, and the Si:Al mole ration is from 1:1 to 50:1. Alternatively, the water insoluble solid can be mixture of amorphous aluminosilicate having the formula $MAlO_2XAl_2O_3.YSiO_2$ and zeolite A.

The drainage/retention aid system can also include a fluid vehicle such as water and a dispersion agent, such as a dispersion agent selected from the group consisting of wetting agents, anionic surfactants, and potassium pyrophosphate.

In addition to the microparticles, the drainage/retention aid system can also comprise a cationic starch and a cationic polyelectrolyte flocculant.

The microparticles of the present invention can be provided as a substantially aggregate-free sodium aluminosilicate sol. The substantially aggregate-free sol is preferably prepared by a two-step process. The first step of the process is the formation of a sodium aluminosilicate sol according to the process disclosed in U.S. Pat. No. 2,974,108. The sol resulting from this process has been found to be highly aggregated and thus not suitable for use in the process for making paper of the present invention. Consequently, a second step is employed whereby the sol is deaggregated to provided suitable microparticles.

Preferably, in the first step an agglomerated reaction product is formed by adding simultaneously, but as separate solutions, an aqueous solution containing about from 1 to 3 percent by weight calculated as $SiO_2$, of active silica and an aqueous solution of an alkali metal aluminate to a vigorously agitated body of water at a temperature from 80 to 100 degrees C. Preferably, there is dissolved therein an amount of alkali sufficient to maintain the pH in the range of from 8 to 12, initially. It is preferred that the proportions of the active silica and aluminate solutions added are such as to maintain the pH in the range of about 9 to 12 during the additions. The soluble salt contents of the agitated mixture and of the solutions added thereto are preferably low enough that the concentration of salt in the aluminosilicate sol formed is less than 0.05 Normal.

Preferably, the second step of the process for preparing the substantially aggregate-free amorphous sodium aluminosilicate microparticles comprises contacting the reaction product with an ion-exchange material in an amount and for a time effective to deagglomerate the reaction product.

Other objects and advantages of the invention and alternative embodiment will readily become apparent to those skilled in the art, particularly after reading the detailed description, and examples set forth below.

DETAILED DESCRIPTION OF THE PREFERRED EMBODIMENTS

Figure 1:
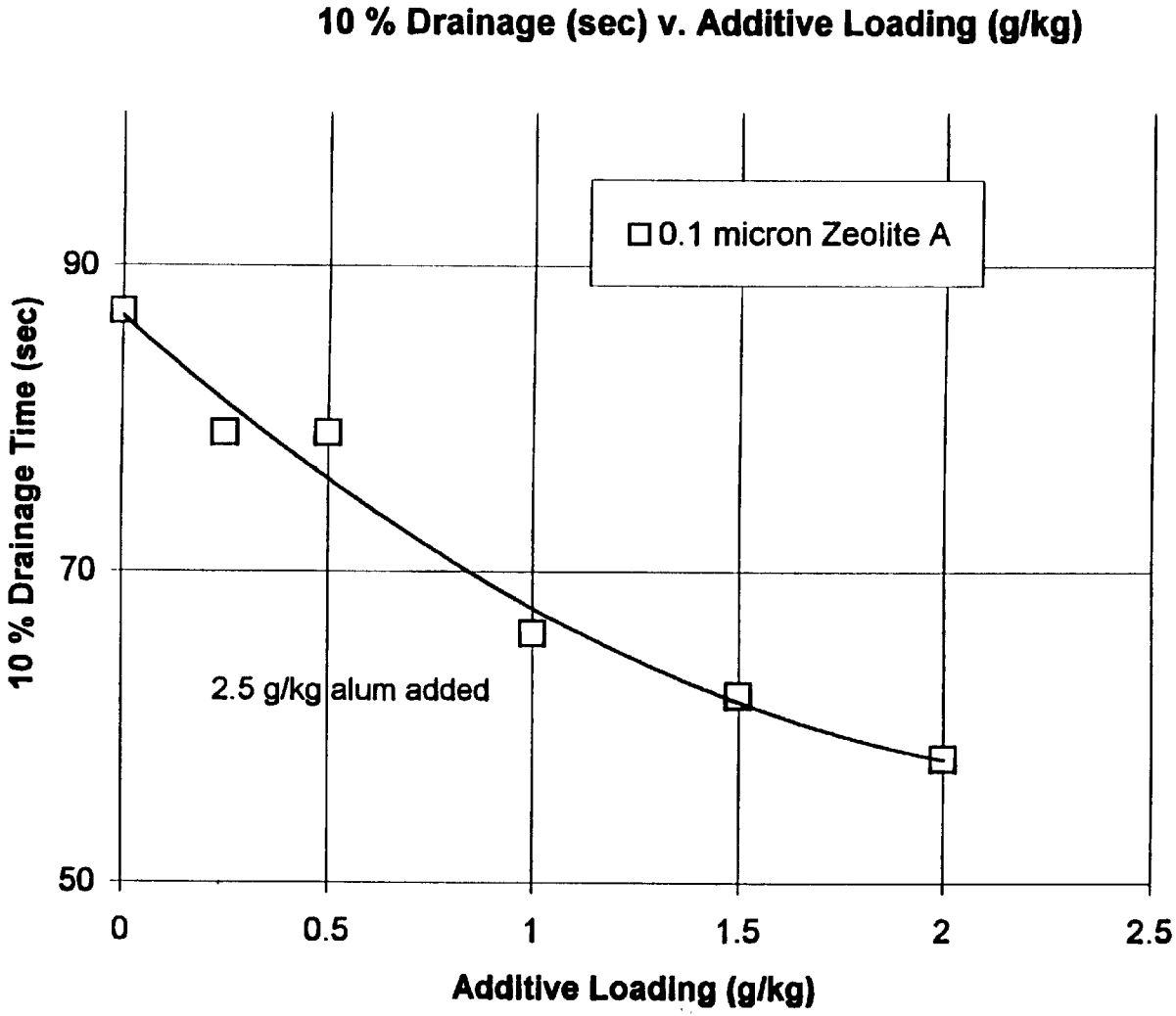
FIG. 1 is a plot of 10% Drainage Time v. Additive Loading for the data of Example 1.

The microparticles of the present invention are finely divided particles of a solid compound having high anionic charge and cationic adsorption properties.

Milling Process

These microparticles can be prepared by a milling process comprising:

(a) providing a feedstock slurry having an average particle size less than one micron to a stirred media mill, the slurry including from about 5 to 10 percent by weight dispersant; and a total solids of less than about 50 percent by weight in a low viscosity fluid;

(b) providing ceramic beads less than 100 microns in diameter in the mill;

(c) filling the mill to a volume in excess of 90%;

(d) operating the mill at tip speeds at least 20 meters/sec; and (e) limiting the residence time to less than about 30 minutes. Preferably, the residence time is limited to less than about two minutes. This will produce particles having an average particle size less than about 0.1 micron from the feedstock. Preferably the size of the diameter of the ceramic beads is no more than about one hundred times the average particle size of the feedstock particles. Preferably, the energy consumption of the mill is maintained below 200 kilowatt-hours per ton of feedstock, and more preferably less than about 100 kilowatt-hours per ton of feedstock.

While microparticles can be prepared by a number of different processes, such as by chemical methods, it believed that this mechanical milling process provides microparticles with unique properties in a cost-effective manner. For example, while wet chemical methods can be used to prepare microparticles of zeolite A, it is believed that microparticles of zeolite A prepared by wet milling from a crystalline feedstock of large particles provides microparticles with physical and chemical surface properties that differ from those of zeolite A microparticles obtained by such chemical methods.

The particle size of the product of the above-described milling process is determined by several processing variables. In addition, the mill type can determine how quickly a particular result can be achieved.

Other factors that affect the ultimate size of the ground material, as well as the time and energy it takes to achieve them include the following:

(1) In wet media milling, smaller media are more efficient in producing finer particles within short milling times of 30 minutes or less.

(2) More dense media and higher tip speeds are desired to impart more energy to the particles being ground, and thereby shorten the time in the mill.

(3) As the particles are reduced in diameter, exposed surface areas increase, and a dispersing agent is generally used to keep small particles from agglomerating. In some cases dilution alone can help achieve a particular ultimate particle size, but a dispersing agent is generally used to achieve long-term stability against agglomeration.

The above and other factors that influence grinding performance are discussed in the paragraphs that follow.

As used herein "particle size" refers to a volumetric average particle size as measured by conventional particle size measuring techniques such as sedimentation, photon correlation spectroscopy, field flow fractionation, disk centrifugation, transmission electron microscopy, and dynamic light scattering. A dynamic light scattering device such as a Horiba LA-900 Laser Scattering particle size analyzer (Horiba Instruments of Japan) is preferred by the present inventors, because it has the advantages of easy sample preparation and speed. The volumetric distribution of the sample relates to the weight through density. A numerical average gives a lower average.

Milling Equipment

The milling equipment preferred for the above-described process is generally known as a wet agitated media mill, wherein grinding media are agitated in a closed milling chamber. The preferred method of agitation is by means of an agitator comprising a rotating shaft, such as those found in attritor mills (agitated ball mills). The shaft may be provided with disks, arms, pins, or other attachments. The portion of the attachment that is radially the most remote from the shaft is referred to herein as the "tip". The mills may be operated in a batch or continuous mode, in a vertical or horizontal position.

In a horizontal media mill, the effects of gravity on the media are negligible, and higher loadings of media are possible (e.g., loadings of up to about 92% of chamber volume); however, vertical media mills can also be employed.

A horizontal or vertical continuous media mill equipped with an internal screen having openings that are ½ to ⅓ the media diameter is preferred.

Conventional fine particle screens for media mills typically employ a plurality of parallel wires having a triangular cross-section ("wedge wire"), with a fixed, small, distance separating the wires at their bases. This inter-wire distance must be smaller than the particle size of the media in order to retain the media in the mill but greater than the average particle size of the product. The smallest inter-wire distance available in wedge wire screens is 0.015 mm±50 percent, or 0.025 mm. At this opening size there is only 1.7 percent open area in the wedge wire screen, causing excessive back pressure and shutdown of the mills. To overcome this problem when using small media, e.g. 15 micron, a composite screen was fabricated. This screen is made by covering a wedge wire screen having 0.500 mm inter wire distance and 32 percent opening with cloth made from stainless steel wires and having 0.20 mm rectangular openings. The composite screen has 8 percent open area and allows the mill to be operated continuously.

An increase in the amount of grinding media in the chamber will increase grinding efficiency by decreasing the distances between individual particles and increasing the number of surfaces available to shear the material to be comminuted. The amount of grinding media can be increased until the grinding media constitutes up to about 92% of the mill chamber volume. At levels substantially above this point, the media does not flow.

Preferably, the media mill is operated in a continuous mode in which the product is recirculated to the input port to the mill. Recirculation of the product can be driven by conventional means, such as by employing a peristaltic pump. Preferably, the product is recirculated as quickly as possible to achieve a short residence time in the mill chamber. Preferably, the residence time in the mill chamber is less than about two minutes.

Starting Materials

Using the above-described process, inorganic solids can be wet milled to particle size levels that are currently not achievable with dry milling techniques.

The size of the feed material that is to be ground is critical to the process of the present invention. For example, while sodium aluminosilicate can be reduced to a 0.20 micron average particle size with commercially available equipment, starting from particles that have an average particle size of 4.5 microns, these larger feed particles require more passes than would be required if the average initial particle size of the feedstock were, for example, less than one micron.

Also it should be noted that the average particle size of the feedstock does not decrease linearly with the number of passes. In fact, it rapidly approaches an asymptote that is presently believed to relate to the "free volume" of the grinding media (i.e. the average interstitial volume).

Media milling can actually grind down particles, rather than merely deagglomerating clumps of pre-sized particles. As a result, faster milling times can be achieved, if smaller starting materials are used. Thus, to reduce milling time, it is preferable to start with particles that are as small as is economically feasible.

Grinding Media

Acceptable grinding media for the above-described process include sand, glass beads, metal beads, and ceramic beads. Preferred glass beads include barium titanate (leaded), soda lime (unleaded), and borosilicate. Preferred metals include carbon steel, stainless steel and tungsten carbide. Preferred ceramics include yttrium toughened zirconium oxide, zirconium silicate, and alumina. The most preferred grinding media for the purpose of the invention is yttrium-toughened zirconium oxide.

Each type of media has its own advantages. For example, metals have the highest specific gravitites, which increase grinding efficiency due to increased impact energy. Metal costs range from low to high, but metal contamination of final product can be an issue. Glasses are advantageous from the standpoint of low cost and the availability of small bead sizes as low as 0.004 mm. Such small sizes make possible a finer ultimate particle size. The specific gravity of glasses, however, is lower than other media and significantly more milling time is required. Finally, ceramics are advantageous from the standpoint of low wear and contamination, ease of cleaning, and high hardness.

The grinding media used for particle size reduction are preferably spherical. As noted previously, smaller grinding media sizes result in smaller ultimate particle sizes. The grinding media for the practice of the present invention preferably have an average size ranging from about 4 to 1000 microns (0.004 to 1.0 mm), more preferably from about 30 to 160 microns (0.03 to 0.16 mm).

Fluid Vehicles

Fluid vehicles in which the particles may be ground and dispersed include water and organic solvents. In general, as long as the fluid vehicle used has a reasonably low viscosity and does not adversely affect the chemical or physical characteristics of the particles, the choice of fluid vehicle is optional. Water is ordinarily preferred.

Wetting Agents/Dispersing Agents

Wetting agents act to reduce the surface tension of the fluid to wet newly exposed surfaces that result when particles are broken open. Preferred wetting agents for performing this function are non-ionic surfactants such as those listed below.

Dispersing agents preferably stabilize the resulting slurry of milled particles by providing either (1) a positive or negative electric charge on the milled particles or (2) steric blocking through the use of a large bulking molecule. An electric charge is preferably introduced by means of anionic and cationic surfactants, while steric blocking is preferably performed by adsorbed polymers with charges which repel each other. Zwitterionic surfactants can have both anionic and cationic surfactant characteristics on the same molecule.

Preferred surfactants for the practice of the invention include non-ionic wetting agents (such as TritonTM X-100 and Triton CF-10, sold by Union Carbide, Tarrytown, N.Y.; and NeodolTM 91-6, sold by Shell Chemical, Houston, Tex.); anionic surfactants (such as Tamol™ 731, Tamol 931 and Tamol SN, sold by Rohm and Haas, Philadelphia, Pa., and Colloid™ 226/35, sold by Rhone Poulenc); cationic surfactants (such as Disperbyke™ 182 sold by Byke Chemie, Wallingford, Conn.); amphoteric surfactants (such as Crosultain™ T-30 and Incrosoft™ T-90, sold by Croda; and non-ionic surfactants (such as Disperse-Ayd™ W-22 sold by Daniel Products Co., Jersey City, N.J. Most preferred dispersion agents are anionic surfactants such as Tamol SN.

Other Milling Parameters

The relative proportions of particles to be ground, fluid vehicles, grinding media and dispersion agents may be optimized.

Preferably, the final slurry exiting the mill comprises the following: (1) 5 to 50 wt %, more preferably 15 to 45 wt %, of the material to be ground; (2) 50 to 95 wt %, more preferably 55 to 85 wt %, of the fluid vehicle; and (3) 2 to 15 wt %, more preferably 6 to 10 wt %, of the dispersion agent.

Preferably the grinding media loading measured as a volume percent of the mill chamber volume is 80 to 95%, more preferably 90 to 93%.

The agitator speed controls the amount of energy that is put into the mill. The higher the agitator speed, the more kinetic energy is put into the mill. Higher kinetic energy results in greater grinding efficiency, due to higher shear and impact. Thus, an increase in agitator rotational speed results in an increase in grinding efficiency. Although generally desirable, it is understood by those skilled in the art that an increase in grinding efficiency will be accompanied by a concurrent increase in chamber temperature, chamber pressure, and wear rate.

The tip speed of the agitator represents the maximum velocity (and, thus, kinetic energy) experienced by the particles to be milled. Thus, larger diameter mills can impart higher media velocities than smaller mills when operating at the same rotational speed.

Residence time (also referred to herein as retention time) is the amount of time that the material spends in the grinding chamber while being exposed to the grinding media. Residence time is calculated by simply determining the grinding volume that is available for the mill and dividing this figure by the rate of flow through the mill (throughput rate), as determined by the operating characteristics of the recirculation pump.

In general, a certain residence time will be required to achieve the ultimate product characteristics desired (e.g., final product size). If this residence time can be reduced, a higher throughput rate can be achieved, minimizing capital costs. For the practice of the present invention, the residence time can vary, but is preferably less than 30 minutes, and more preferably less than two minutes.

It is often desirable to stage two or more mills in series, particularly when dramatic reductions in particle size are necessary, or when narrow particle size distributions are necessary. In general, size reduction of particles within a given milling step can range from about 10:1 to as high as about 40:1. As a result, the number of milling steps increases as the overall size reduction requirement increases. For example, assuming that one wishes to reduce material having a nominal diameter of 100 microns to an ultimate particle size of 0.1 microns, then three mills in series would preferably be used. Similar effects can also be achieved using a single mill by collecting the output and repeatedly feeding the output through the mill.

Commercial zeolite A, crystalline sodium alumino silicate has a zeta potential at pH 7–8 of minus 40 millivolts which is comparable to the −50 millivolts of bentonite clay and the -60 millivolts of BMA—colloidal silica produced by EKA.

Unfortunately the zeolite A as offered commercially has a large 4.6 micron particle size. The BMA colloidal silica has a 0.005 micron particle size which results in an external surface area of 600 sq. meters/gm.

The EZA zeolite from Albemarle Corporation has an internal surface area of 300 sq. meters/gm and an external surface area at 4.6 microns of 0.6 sq. meters/gm. By milling it to 0.015 microns the external area is increased to 180 sq. meters/gm and the total surface area available for cationic adsorption is raised to 480 sq. meters/gm which is 80% of the BMA colloidal silica surface area.

The zeta potential of particles can be altered by adsorbing ionic materials into the crystal lattice. Potassium pyrophosphate is particularly effective for this purpose.

Milled zeolite A useful in the present invention can be prepared as follows:

A 30% by weight dispersion of 4.6 micron zeolite A (Albemarle Corporations EZA) is prepared using potassium pyrophosphate as the dispersant. The material is fed to a Netzsch horizontal media mill Netzsch model LMZ-IO containing 0.2 mm of YTZ beads. The mill is operated at 1700 rpm. After four passes through the mill the material reaches a particle size of 0.10 microns. The product has a zeta potential of -54.6 millivolts and a surface area of 300 sq. meters per gm.

Zeolite A can be milled in a commercial horizontal media a mill filled with 150 micron YTZ beads (available from Tosoh Corp. as developmental media) to an 0.05 micron average particle size and a surface area of 360 sq. mm per gm.

Zeolite A can be further milled with 0.50 micron YTZ available from screened commercially available beads so that the particle size after 4 passes would be 0.015 microns, and the surface area would be 480 sq. m/gm.

Amorphous Materials

Aluminosilicate "aquasols" (aqueous sols) can also be employed in the process of the present invention. Useful aquasols can be prepared by the synthetic process disclosed in U.S. Pat. No. 2,974,108. For example, aluminosilicate aquasols can be prepared by adding solutions of active silica and an alkali metal aluminate, such as sodium aluminate, simultaneously to an aqueous alkali solution having a pH of 8 to 12. The active silica can be prepared by diluting a sodium silicate solution to a silica weight concentration of 1 to 3 percent, and then passing the diluted sodium silicate solution through a column of cation-exchange resin in the hydrogen form. The alkali metal aluminate solution is preferably freshly prepared, and contains an excess of alkali in order to discourage pre-polymerization of the aluminate. Preferably, the alkali metal aluminate solution and the active silica solution are added to the aqueous alkali solution at a low temperature, in order to favor the formation of small particles. It is also preferable to add the alkali metal aluminate solution and the active silica solution together rapidly, so as to promote the formation of small particles. Further, it is preferable to avoid soluble electrolytes, and in particular soluble electrolytes providing polyvalent ions, in the aqueous alkali solution, in order to avoid or minimize the coagulation of the solid sol particles formed. Preferably, the reaction product is treated with an ion exchange resin such as Purolite® NRW-100 SC in the hydrogen form. This was followed by Purolite® NRW-600 SC in the hydroxide form in order to deflocculate any incidental aggregation of the sol particles, to provide a clear to translucent solution. Examples of ion-exchange resins that can be employed include the following:

| | |
|---|---|
| Purolite ® NRW 37SC | a mixture of strong acid and strong base resin |
| Amberlite ® IRN 77 | cation hydrogen form |
| Amberlite ® IRN 78 | anion hydroxide form (trimethyl amine) |
| Amberlite ® IRA 400 | cation hydrogen form |
| Amberlite ® IRA 120 | anion hydroxide form |
| Amberjet ® 1500 H | cation hydrogen form |
| Amberjet ® 4400 | anion hydroxide form (quaternary ammonium) |

Drainage/Retention Aid Systems

The microparticles of the present invention can be employed in a variety of drainage/retention aid systems. Many polymeric materials can be used for preparing drainage/retention aids in the manufacture of paper and paperboard. "Retention" refers to the extent to which the wood pulp fibers, and other materials such as filler, and additives for the furnish such as sizing agents, are retained in the paper sheet formed in the papermaking machine. A retention aid is added to increase the tendency of pulp wood fibers, fillers, and other solid materials suspended in the furnish to flocculate and be retained on the paper sheet-forming screen and to reduce the loss of such materials during drainage of the suspension water through the screen. "Drainage" refers to the reduction in the water content of the aqueous pulp suspension on the sheet-forming screen of the papermaking machine. Optimally, drainage is accomplished as quickly as possible. Drainage/retention aid systems are often preferably prepared to optimize these two somewhat contradictory properties. A number of factors are known to affect retention and drainage, including the composition of the furnish, such as the type and physical characteristics of the pulp fiber employed, the pH of the furnish, the temperature of the furnish, the extent to which water is recirculated through the papermaking system, whether a filler is present, and if so, the physical characteristics of the filler, and the consistency of the materials. Other factors relate to characteristics of the papermaking machine employed, such as the size of the mesh of the screen, the rate though which the furnish is processed by the machine, and the like. Finally, there are factors which relate to the additives to the furnish, including the chemical and physical characteristics of the additives, such as the shape, size, and charge characteristics of the additives, whether the additives are dissolved or suspended in the furnish, etc. In particular, drainage rates in papermaking machines depend on a variety of factors including the physical and mechanical characteristics of the papermaking machine itself, the physical dimensions and arrangement of the wires used in the screen, and the furnish characteristics. Drainage/retention aids preferably prevent loss of fibers and additives by drainage, as well as promote rapid drainage.

The microparticles of the present invention are preferably employed in two or three component drainage/retention aid systems, which include one or two cationic materials for interaction which the anionic microparticles.

Cationic Starch

Examples of cationic materials useful for the present invention include modified natural polymeric materials such as cationic starch. Preferably, the cationic starch has limited solubility in the alkaline furnish containing cellulosic fibers and particulate materials. By "cationic starch" is meant a natural starch that has been chemically modified to provide cationic functional groups. Examples of natural starches that can be so modified include starch derived from potatoes, corn, maize, rice, wheat, or tapioca. Depending on their source, natural starches include one or more natural polysaccharides, such as amylopectin and amylose. The physical form of the starch used can be granular, pre-gelatinized granular, or dispersed in an aqueous vehicle. Granular starch must be swollen by cooking before dispersion. When starch granules are swollen and gelatinized to a point just prior to becoming dispersed in the cooking medium they are referred to as being "fully cooked." Dispersion conditions depend on starch granule size, the extent of crystallinity, and the chemical composition of the granules, and in particular, the proportion of linear polysaccharide amylose. Dispersion of pre-swollen or fully cooked starch granules can be accomplished using suitable mechanical dispersion equipment, such as eductors, to avoid the gel-blocking phenomenon.

Cationic starches include starches modified to include tertiary aminoalkyl ether functional groups, starches modified to include quaternary ammonium alkyl ether functional groups, starches including phosphonium functional groups, starches including sulfonium functional groups, starches including imino functional groups, and the like. Typically, cationic starches include cationic functional groups at a degree of substitution ranging from about 0.01 to 0.1 cationic functional group per starch anhydroglucose unit. Cationic starch particles are believed to have a generally globular structure when fully dispersed.

The cationic starch can be added directly to the aqueous papermaking furnish, preferably before final dilution of the furnish. The cationic starch can be added at a rate of from about one to ten times the rate, on a weight basis, of the synthetic polymeric cationic flocculant used.

Cationic Flocculants

Examples of cationic materials useful for the present invention also include those synthetic polymeric materials known in the industry as "cationic flocculants," which tend to increase the retention of fine solids in the furnish on the papermaking web. Cationic flocculants are polyelectrolyte materials typically prepared by copolymerization of ethylenically unsaturated monomers, typically substituted acrylate esters, and including one or more cationic comonomer. Examples of cationic comonomers include acid salts and quaternary ammonium salts of dialkylamino alkyl (meth) acrylates and dialkylamino alkyl (meth)acrylamides, such as quaternary ammonium salts of diethyl aminoethyl methacrylate, acid salts of diethyl aminopropyl methacrylate, quaternary ammonium salts of dimethyl aminoethyl methacrylamide, and the like. Cationic monomers are typically copolymerized with nonionic monomers such as acrylamide, methacrylamide, ethyl acrylate, and the like. Other types of cationic polymers which can be used as cationic flocculants include polyethylene imines, copolymers of acrylamide and diallyl dimethyl ammonium chloride, polyamides functionalized with epichlorohydrin, and the like. Cationic charge densities can range from about 0.1 to 2.5 milliequivalents per gram of polymer. Examples of cationic flocculants include synthetic copolymeric polyacrylamides, polyvinylamines, N-vinylaminde/vinylamine copolymers, copolymers of vinylamine, N-vinylformamide and N-monosubstituted or N,N-disubstituted acrylamides, water-soluble copolymers derived from N-vinylamide monomers and cationic quaternary ammonium comonomers. Cationic flocculants are typically substantially linear polymers, and have molecular weights ranging from about 500,000 up to 1–5,000,000. The rate at which a specific cationic flocculant is to be used depends on the properties of the cationic flocculant and can range from about 0.005 percent by weight, based on the dry weight of the polymer and the dry finished weight of the paper produced, up to about 0.5 percent, with typical usage rates ranging about 0.1 percent.

Another additive often employed in papermaking is a low molecular weight cationic species, such as alum, which is used to adjust the zeta potential of the aqueous furnish. Since unmodified cellulosic fibers have an anionic surface charge, as do many of the inorganic materials used as fillers, such as titanium dioxide, a cationic species such as alum is believed to partially neutralize the anionic surface charge of these components of the alkaline furnish, making these components more susceptible to flocculation. In addition to alum, other types of low molecular weight cationic species, including low molecular weight polymers, such as cationic polyelectrolytes having a molecular weight of from about 100,000 to about 500,000, and a charge density of about 4 to 8 milliequivalents of cationic species per gram of polymer. Examples include Cypro™ 514, a proprietary low molecular weight cationic species available from Cytec Industries, Inc., Stamford, Conn. The amount of low molecular weight cationic species employed depends on a number of factors, including the nature and amount of cationic flocculant and/or cationic starch employed. Small amounts of alum and the like can increase retention, presumably by binding to anionic surface charges which are not accessible for steric reasons to cationic starch particles and/or polyelectrolyte cationic flocculants, and thus reducing repulsion between cellulosic fibers and/or filler particles. However, if too much of the low molecular weight cationic species is used, then binding of the cationic starch and/or polyelectrolyte cationic flocculant may be reduced, resulting in an undesirable decrease in retention.

EXAMPLES

The following examples, as well as the foregoing description of the invention and its various embodiments, are not intended to be limiting of the invention but rather are illustrative thereof. Those skilled in the art can formulate further embodiments encompassed within the scope of the present invention.

Comparative Example 1

A simulated alkaline fine paper furnish was prepared. The simulated furnish comprised an aqueous suspension (0.1 percent total solids) consisting of cellulosic fiber and 30 percent precipitated calcium carbonate filler in a dry weight ratio of 7:3 at a pH of 8.4. Drainage time was measured using a Canadian Freeness Tester for a volume of 250 ml. In these examples, the amounts of additives employed are expressed as grams of additive per kilogram of the total solids of the furnish. To the simulated furnish, a drainage/retention aid system comprising 5 g/kg of cationic starch, 2.5 g/kg of alum, and 1.5 g/kg of Accurac™ 181 (commercial cationic polyacrylamide available from Cytec Industries, Inc., Stamford, Conn.). The 10 percent drainage time was measured to be 87 seconds.

Example 1

Comparative Example 1 was repeated, except that after addition of the polyacrylamide, zeolite A milled to a 0.1 micron particle size was added, and the 10 percent drainage time was measured, as follows:

| Run Number | Weight zeolite A added | 10% retention time |
|---|---|---|
| 1 | 0.2 g/kg | 79 seconds |
| 2 | 0.5 g/kg | 79 seconds |
| 3 | 1.0 g/kg | 66 seconds |
| 4 | 1.0 g/kg | 77 seconds (alum omitted) |
| 5 | 1.5 g/kg | 62 seconds |
| 6 | 2.0 g/kg | 58 seconds |

These results, which are plotted in FIG. 1, show the milled 0.1 micron zeolite A is effective in a cationic starch/polyacrylamide retention/drainage aid system for making paper using an alkaline furnish.

Example 2

Example 1 was repeated, except that alum was omitted, and the following results were obtained:

| Run Number | Weight zeolite A added | 10% retention time |
|---|---|---|
| 1 | 0.5 g/kg | 78 seconds |
| 2 | 1.5 g/kg | 59 seconds |
| 3 | 2.5 g/kg | 47 seconds |
| 4 | 3.5 g/kg | 42 seconds |

These results show that 0.1 micron zeolite A is effective in a cationic starch/polyacrylamide drainage/retention aid system.

Example 3

Example 2 was repeated, except that zeolite A milled to a particle size of 0.07 microns substituted for the 0.1 micron zeolite A, and the following results were obtained:

| Run Number | Weight 0.07 micron zeolite A added | 10% retention time |
|---|---|---|
| 1 | 0.5 g/kg | 84 seconds |
| 2 | 1.5 g/kg | 61 seconds |
| 3 | 2.5 g/kg | 48 seconds |
| 4 | 3.5 g/kg | 45 seconds |

These results show that smaller particle size zeolite A is also effective in reducing the retenion time.

Figure 2:
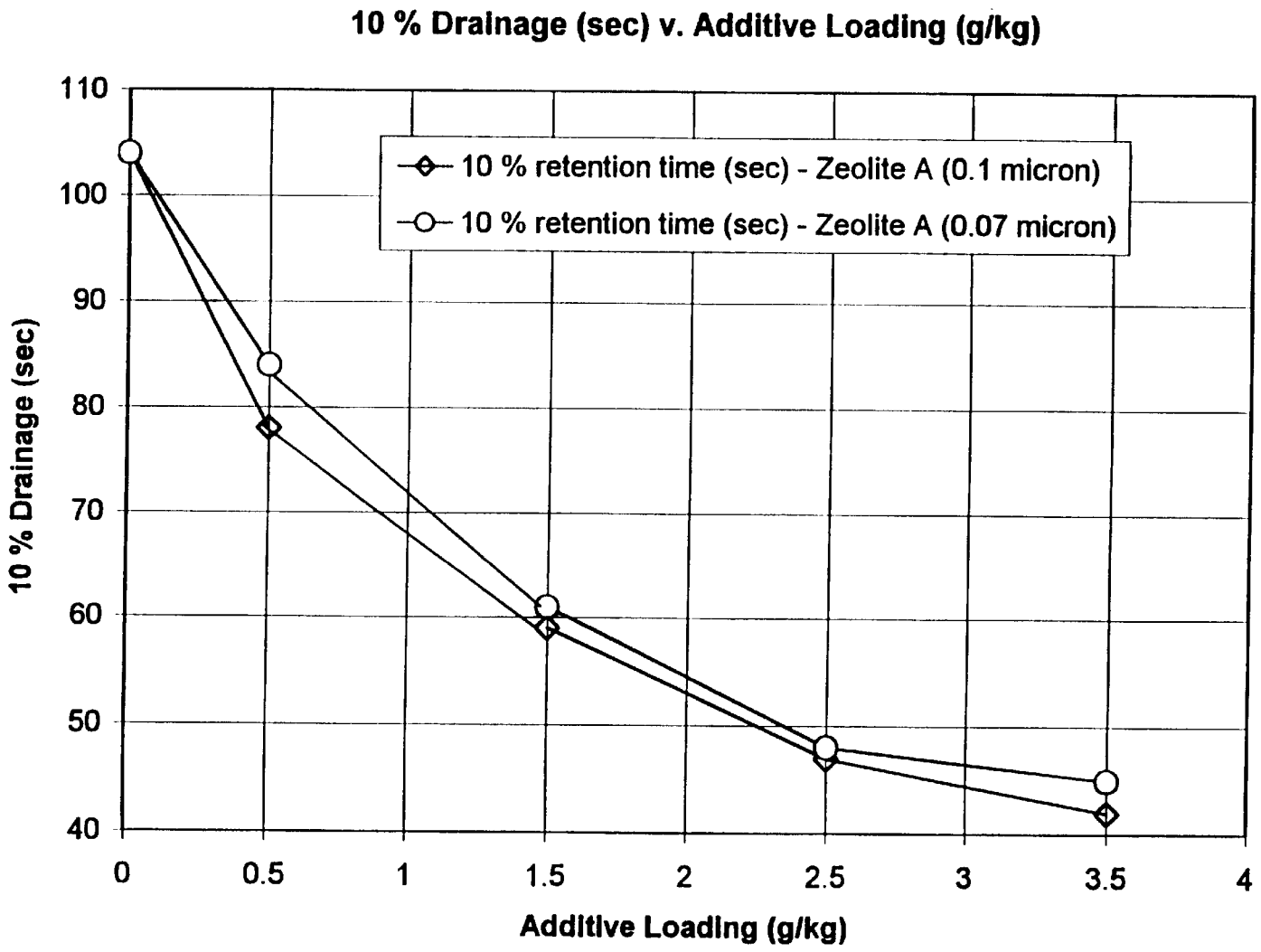
FIG. 2 is a plot of 10% Drainage Time v. Additive Loading for the data of Examples 2 and 3.
Figure 3:
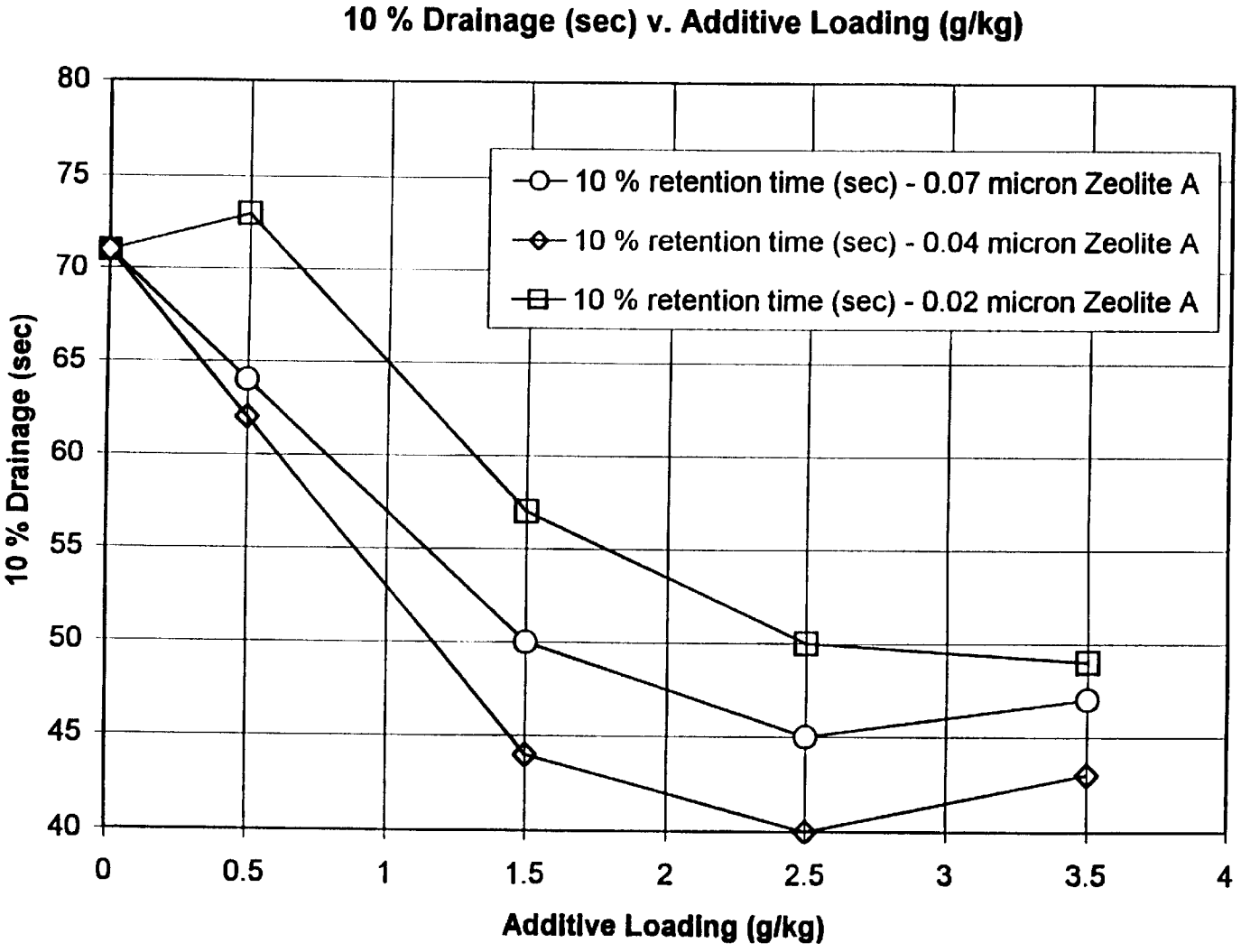
FIG. 3 is a plot of 10% Drainage Time v. Additive Loading for the data of Example 4.

The results obtained in Examples 2 and 3 are displayed in FIG. 2.

Example 4

Example 2 was again repeated, except that a series of zeolite A samples milled to particle sizes of 0.02, 0.04 and 0.07 microns, respectively, were substituted for the 0.1 micron zeolite A, and the following results were obtained:

| Weight added | 0.02 micron Zeolite A | 0.04 micron Zeolite A | 0.07 micron Zeolite A |
|---|---|---|---|
| | 10% Drainage Time (sec) for 250 ml | | |
| 0 g/kg | 71 seconds | 71 seconds | 71 seconds |
| 0.5 g/kg | 73 seconds | 62 seconds | 64 seconds |

-continued

| Weight added | 0.02 micron Zeolite A | 0.04 micron Zeolite A | 0.07 micron Zeolite A |
|---|---|---|---|
| 1.5 g/kg | 57 seconds | 44 seconds | 50 seconds |
| 2.5 g/kg | 50 seconds | 40 seconds | 45 seconds |
| 2.5 g/kg | 47 seconds (w/2.5 g/kg alum) | 37 seconds w/2.5 g/kg alum) | 42 seconds (w/2.5 g/kg alum) |
| 3.5 g/kg | 49 seconds | 43 seconds | 47 seconds |

These results show that microparticles of Zeolite A when combined with cationic starch and high molecular weight polyacrylamide polymer can reduce the drainage time of a paper furnish by as much as 60% when compared to using no microparticles. The use of alum addition improves the zeolite performance by an additional six percent.

Example 5

A sol of an amorphous sodium aluminosilicate was prepared as follows. A heel of 1.5 liters of water was heated to reflux. Two feed solutions were added to the heel over a six hour period while maintaining the temperature at 90–95 degrees C. with vigorous agitation. The first feed solution was 1.2 liters of a 2% silicic acid prepared from a sodium silicate solution diluted to 2 percent $SiO_2$ content and passed through a cation exchange resin in the hydrogen form. The second feed solution was 1.2 liters of a sodium aluminate solution prepared by dissolving 42 g of sodium aluminate in distilled water and diluting. The resulting sodium aluminate sol was deionized and concentrated but had a flocculated appearance. The sol was deaggregated by passing the sol through a cation exchange resin in the hydrogen form followed by an anion exchange resin to give a clear-translucent dispersion of the sol. The particle size was measured by transmission electron microscopy to be about 15 nanometers and the solids were found to be 0.72 percent by weight. The sol performed very effectively as a microparticle in a retention and drainage aid system. The performance was equal to that of bentonite.

Various modifications can be made in the details of the various embodiments of the compositions of the present invention, all within the scope and spirit of the invention and defined by the appended claims.

What is claimed is:

1. A process for making paper from an alkaline furnish, the process comprising:

a) adding a cationic starch to the furnish;

b) adding a cationic polyelectrolyte flocculant to the furnish; and c) adding to the furnish a microparticle composition comprising finely divided particles of a water insoluble, solid compound selected from the group consisting of amorphous alumino silicates, mixed crystalline/amorphous aluminosilicates, and diatomaceous earth, the solid compound having an anionic charge of at least 20 millivolts and a particle size of no greater than about 0.1 micron, a fluid vehicle, and a dispersion agent selected from the group consisting of wetting agents and anionic surfactants.

2. A process according to claim 1 wherein said solid compound is sodium aluminosilicate sol, wherein said sol is prepared by (a) the step of forming an agglomerated reaction product by adding simultaneously, but as separate solutions, an aqueous solution containing about from 1 to 3 percent by weight calculated as $SiO_2$, of active silica and an aqueous solution of an alkali metal aluminate to a vigorously agitated body of water having dissolved therein, at a temperature from 80 to 100 degrees C., an amount of alkali sufficient to maintain the pH in the range of from 8 to 12, initially, and the proportions of said active silica and aluminate solutions added being such as to maintain the pH in the range of about 9 to 12 during said additions, and the soluble salt contents of the agitated mixture and of the solutions added thereto being low enough that the concentration of salt in the aluminosilicate sol formed in substantially greater than 0.05 Normal; and (b) the step of contacting said reaction product with an ion-exchange material in an amount and for a time effective to deagglomerate said reaction product.

3. A process according to claim 1 wherein the solid compound is diatomaceous earth.

4. A process according to claim 1 wherein the anionic charge is from 40 to 60 millivolts.

5. A process according to claim 1 wherein said particle size is no greater than about 0.04 micron.

* * * * *